US010087702B2

(12) United States Patent
Ewing et al.

(10) Patent No.: US 10,087,702 B2
(45) Date of Patent: Oct. 2, 2018

(54) PLUG RELEASER AND METHOD OF LIMITING PRESSURE DIFFERENTIAL ACROSS PLUGS

(71) Applicants: Daniel C. Ewing, Katy, TX (US); Christopher Ryan Hern, Porter, TX (US); Matthew J. Krueger, Spring, TX (US)

(72) Inventors: Daniel C. Ewing, Katy, TX (US); Christopher Ryan Hern, Porter, TX (US); Matthew J. Krueger, Spring, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 491 days.

(21) Appl. No.: 14/733,364

(22) Filed: Jun. 8, 2015

(65) Prior Publication Data

US 2016/0356114 A1 Dec. 8, 2016

(51) Int. Cl.
*E21B 33/12* (2006.01)

(52) U.S. Cl.
CPC ..... *E21B 33/12* (2013.01)

(58) Field of Classification Search
CPC ..... Y10T 137/87917; E21B 34/063; E21B 33/12
USPC ..... 166/193
See application file for complete search history.

(56) References Cited

U.S. PATENT DOCUMENTS

| | | | | |
|---|---|---|---|---|
| 3,533,430 | A * | 10/1970 | Fredd | E21B 34/08 137/112 |
| 5,909,771 | A * | 6/1999 | Giroux | E21B 21/10 166/120 |
| 6,634,428 | B2 | 10/2003 | Krauss et al. | |
| 8,245,788 | B2 | 8/2012 | Garcia et al. | |
| 8,316,951 | B2 | 11/2012 | Fay et al. | |
| 2011/0198097 | A1* | 8/2011 | Moen | E21B 34/08 166/373 |
| 2014/0083716 | A1* | 3/2014 | Frazier | E21B 34/063 166/376 |
| 2017/0037980 | A1* | 2/2017 | Arian | F16K 31/1221 |

OTHER PUBLICATIONS

Ludvigsen, et al., "Fundamentals of Pressure Relief Valves", American School of Gas Measurement Technology, Jan. 12, 2013; 10 pages.

* cited by examiner

*Primary Examiner* — George Sterling Gray
(74) *Attorney, Agent, or Firm* — Cantor Colburn LLP

(57) ABSTRACT

A plug releaser includes, a first tubular with at least one first port through a wall thereof, at least two plugs sealingly engaged with the first tubular defining a first chamber between the first tubular and the at least two plugs. The at least two plugs are rupturable or releasable from the first tubular at selected pressure differentials thereacross, and a second tubular is in operable communication with the first tubular at locations beyond the at least two plugs. The at least one first port provides fluidic communication between the first chamber and an outside of both the first tubular and the second tubular and the at least one first port is sized to prevent pressure differential across the at least two plugs from building to a selected pressure differential needed to rupture or release the plugs in either direction for at least a period of time.

19 Claims, 2 Drawing Sheets

PLUG RELEASER AND METHOD OF LIMITING PRESSURE DIFFERENTIAL ACROSS PLUGS

BACKGROUND

Tubular systems often employ plugs to at least temporarily plug an opening to allow pressure to be build upstream thereof to facilitate an actuation, for example. Such systems are commonly used in boreholes drilled into earth formations in the carbon dioxide sequestration and hydrocarbon recovery industries. It may be desirable to locate one or more plugs along a tubular so that one does not have to be introduced a new plug to the tubular from an extreme end thereof. Systems and methods that allow for controlling release of intermediately located plugs only when desired and not prematurely is of interest to those who practice in arts concerned with such matters.

BRIEF DESCRIPTION

Disclosed herein is a plug releaser. The plug releaser includes, a first tubular with at least one first port through a wall thereof, at least two plugs sealingly engaged with the first tubular defining a first chamber between the first tubular and the at least two plugs. The at least two plugs are rupturable or releasable from the first tubular at selected pressure differentials thereacross, and a second tubular is in operable communication with the first tubular at locations beyond the at least two plugs. The at least one first port provides fluidic communication between the first chamber and an outside of both the first tubular and the second tubular and the at least one first port is sized to prevent pressure differential across the at least two plugs from building to a selected pressure differential needed to rupture or release the plugs in either direction for at least a period of time.

Further disclosed is a method of limiting pressure differential across plugs sealing a chamber within a tubular. The method includes, porting fluid to or from the chamber through a port in a wall of the chamber to an outside of the chamber, the porting fluid thereby decreasing pressure differential across the plugs in comparison to a method not including the porting of fluid regardless of a direction of pressure change across the plugs that created the pressure differential across the plugs.

Further disclosed is a plug releaser including a tubular, a housing slidably sealingly engaged with the tubular defining a chamber therebetween, and at least one plug sealingly engaged with at least one of the tubular and the housing configured to rupture or release at a selected pressure differential thereacross. A volume of the chamber is alterable to allow temporal pressure differences across the at least one plug to be reduced by sliding the housing relative to the tubular in comparison to what the pressure differences across the at least one plug would be if the housing were not allowed to move.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
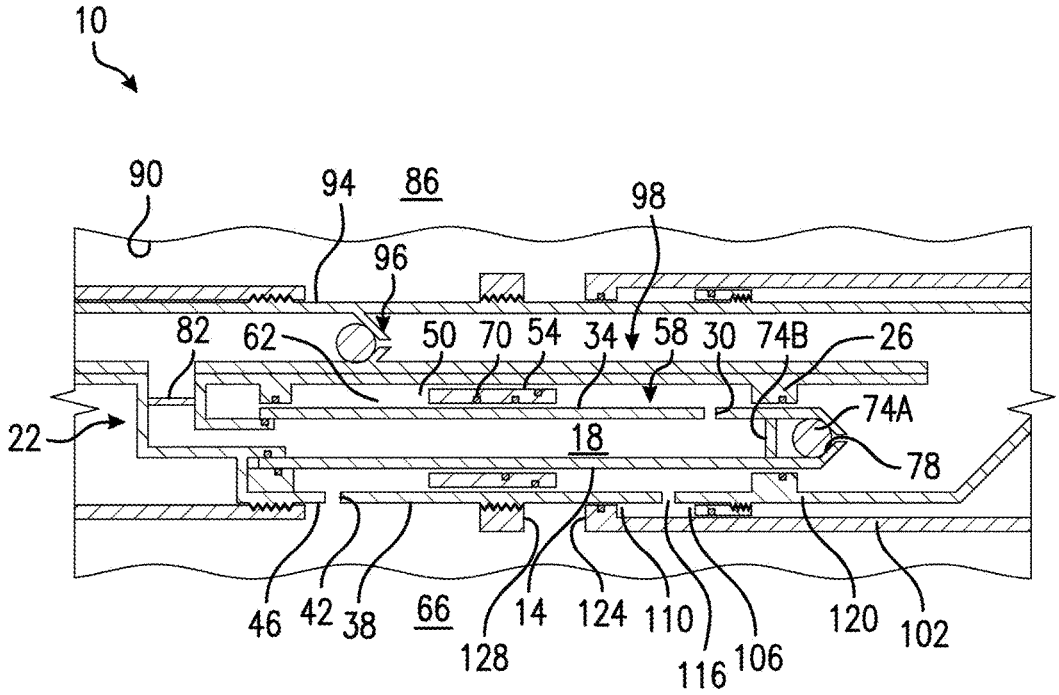
FIG. 1 depicts a cross sectional view of a plug releaser disclosed herein.

Referring to FIG. 1, an embodiment of a plug releaser disclosed herein is illustrated at 10. The plug releaser 10 includes, a first tubular 14 defining a first chamber 18 that is plugged at two longitudinal locations 22, 26 by at least one plug 74A, 74B at one of the longitudinal locations 22, 26 and at least one plug 82 at the other of the two longitudinal locations 22, 26, with three being illustrated. The first tubular 14 has one or more first ports 30, with just one being shown in the drawing, through a wall 34 of the first tubular 14. A second tubular 38 has one or more ports 42, with just one being shown, through a wall 46 of the second tubular 38. The second tubular 38 is positioned radially outwardly of the first tubular 14 thereby defining an annular space 50 between the first tubular 14 and the second tubular 38. A piston 54 is slidably positioned within the annular space 50 dividing the annular space 50 into a second chamber 58 and a third chamber 62. The first chamber 14 is in fluidic communication with the second chamber 58 through the first port 30 and the third chamber 62 is in fluidic communication with an outside 66 of the second tubular 38 through the at least one second port 42. The piston 54 is movable within the annular space 50 in response to fluid flowing from the first chamber 18 to the second chamber 58 through the first port 30 to at least temporarily prevent a pressure differential across the plugs 74A, 74B, 82 from building to a selected pressure differential needed to rupture or release the plugs 74A, 74B, 82. The pressure within the first chamber 18 being maintained while the piston 54 is moved at a value less than would be maintained if the piston 54 were not allowed to move. The increases in pressure in the chamber 18 can be due to increases in temperature of fluid within the chamber 18, for example.

The piston 54 is sealed to both the first tubular 14 and the second tubular 38, and is movable while sealed in response to a pressure differential developed thereacross between the second chamber 58 and the third chamber 62. As such the piston 54 can be moved in either longitudinal direction depending upon which of the two chambers 58 and 62 has greater pressure. A release member 70 fixes the piston 54 to the first tubular 14 until a force to move the piston 54 exceeds a threshold value. Alternatively, the release member 70 could fix the piston 54 to the second tubular 38 instead of or in addition to the first tubular 14. The piston 54 can be configured to move sufficiently far relative to the second tubular 38 to block flow through the second port 42. Once the second port 42 is blocked the piston 54 ceases to move and pressure within the first chamber 18 and second chamber 58 can equalize. In addition to equalizing the pressure within the chambers 18 and 58 can increase. If increased enough pressure within the first chamber 18 can cause the plugs 74A, 74B, 82 at one or both of the locations 22, 26 to rupture or extrude as will be described in more detail below. The flowing of fluid from the first chamber 18 to the second chamber 58 allows for maintaining pressure for a time period within the first chamber 18 at a lower value than would be attained had the fluid not been allowed to flow out from the first chamber 18 and to cause the piston 54 to move.

The flow area through the first port 30 can be set to throttle flow therethrough. Doing so can control a rate of movement of the piston 54 and control a rate of pressure equalization between the two chambers 18 and 58.

The first chamber 18 is plugged at the first location 26 by the plugs 74A, 74B. The first plug 74A is a ball that is extrudable through a seat 78, and is thus releasable from the plug releaser 10, when pressure differential exceeds a threshold value. The second plug 74B is a rupture disc that can rupture at the same or a different threshold value of pressure differential thereacross than that of the first plug 74A. The plug 82, shown herein as a rupture disc, plugs the first chamber at the second location 22. The plug 82 is defeatable when pressure differential thereacross exceeds another threshold value. The threshold values can all be set to different values or the same values. Setting the threshold values at levels greater than values anticipated to be encountered while running the plug releaser 10 into an earth formation 86 borehole 90, for example when employed in a hydrocarbon recovery or carbon dioxide sequestration application, will provides an operator with confidence that the plugs 74A, 74B, 82 will not be released or ruptured prematurely. Increases in pressure within the chamber 18 are likely to occur when temperature of fluids within the chamber 18 increase at the elevated temperatures that exist in a downhole environment. The plug releaser 10 disclosed herein can also be employed to prevent premature rupture of the plugs 74B and 82 due to increases in hydrostatic pressure within a third tubular 94 or outside of the port 42, for example, that could be experienced while running the plug releaser 10 into the borehole 90 in the earth formation 86. It should be noted that the tubulars 14, 38, 94, 102, 232, 314, 338, and 514 disclosed herein, rather than being members that are separate from one another could alternately be formed as bores through one or more pieces of a solid material, for example.

The third tubular 94 is fluidically connected to the first chamber 18 beyond the locations 22, 26. As such, the plug 74A upon release from the first chamber 18 can flow into the third tubular 94. Once within the third tubular 94 the plug 74A is able to be used in the actuation of tools or treatment of earth formations by plugging seats (not shown) within the third tubular 94, for example. A blockage 96 within the third tubular (whether originally present or generated when desired) in a portion 98 of the third tubular 94 that is parallel with the first chamber 18, whether temporary or permanent, can allow pressure within the third tubular 94 to first cause the plug 82 to rupture or release and subsequently to cause the other plugs 74A, 74B to rupture or release.

Optionally, a fourth tubular 102 is sealingly slidably engaged with the second tubular 38 defining a fourth chamber 106 in a second annular space 110 defined therebetween. In an embodiment with the fourth tubular 102 a fourth port 116 in a wall 120 of the second tubular 38 fluidically connects the second chamber 58 to the fourth chamber 106. The foregoing structure allows the fourth chamber 106 to increase in volume upon movement of the fourth tubular 102 relative to the second tubular 38 until movement thereof is stopped. In the illustrated embodiment the stoppage is due to contact between a shoulder 124 on the fourth tubular 102 and a stop 128 fixed to the second tubular 38. The movement of the fourth tubular 102 relative to the second tubular 38 allows for actuation of a tool (not shown) prior to rupture or release of the plugs 74A, 74B, for example.

Figure 2:
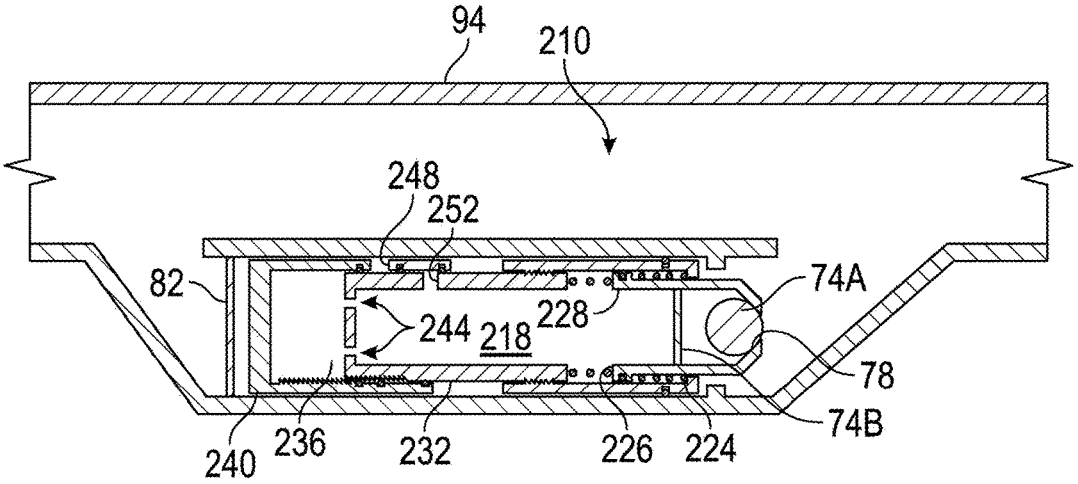
FIG. 2 depicts a cross sectional view of an alternate embodiment of a plug releaser disclosed herein.

Referring to FIG. 2, an alternative embodiment of a plug releaser disclosed herein is illustrated at 210. The plug releaser has similarities to the plug releaser 10; as such similar elements will be designated with the same reference characters and not explained again in detail hereunder. One difference between the plug releasers 10 and 210 is that a volume of the first chamber 18 is fixed while a volume of a fifth chamber 218 of the plug releaser 210 is not. Instead, a volume of the fifth chamber 218 is allowed to increase as pressure within the fifth chamber 218 increases as in response to an increase in temperature of fluid positioned therewithin, for example. The increase in the fifth chamber 218 causes a biasing member 224 to longitudinally compress as the housing 228, with the plugs 74A and 74B, is moved (rightward in the Figure) relative to a fifth tubular 232. This volumetric expansion of the fifth chamber 218 allows maintaining pressure for a time period within the fifth chamber 218 at a lower value than would be needed to release at least one of the plugs 74A, 74B. The pressure within the fifth chamber 218 during expansion thereof being less than would be created if the volume of the fifth chamber 218 were not allowed to expand.

Alternately, pressure increases within the third tubular 94 that cause increases in pressure differential across the plugs 74A, 74B and 82 in a direction opposite to that discussed above can also be maintained at a lower level by the plug releaser 210. Such changes in pressure differential can be caused by changes in pressure within the tubular 94, such as by changes in hydrostatic pressure within the tubular 94, for example. A volume within the fifth chamber 218 is allowed to decrease by movement of the housing 228 (leftward in the Figure) thereby compressing biasing member 226 in the process.

As with the plug releaser 10 increases in pressure within the third tubular 94 when sufficiently large create pressure differential across the plug releaser 210 to cause the plug 82 to rupture. After such rupture fluid in a sixth chamber 236 defined between a cap 240 and the fifth tubular 232 is allowed to flow through openings 244 in the fifth tubular 232 and thereby increase pressure within the fifth chamber 218. Additionally, the movement of the cap 240 allows ports 248 in the cap 240 to align with ports 252 in the fifth tubular 232 to allow fluid to flow into the fifth chamber 218 from within the third tubular 94 directly. Such fluid communication allows pressure within the fifth chamber 218 to increase until the plugs 74A, 74B are ruptured or released from the plug releaser 210.

Figure 3:
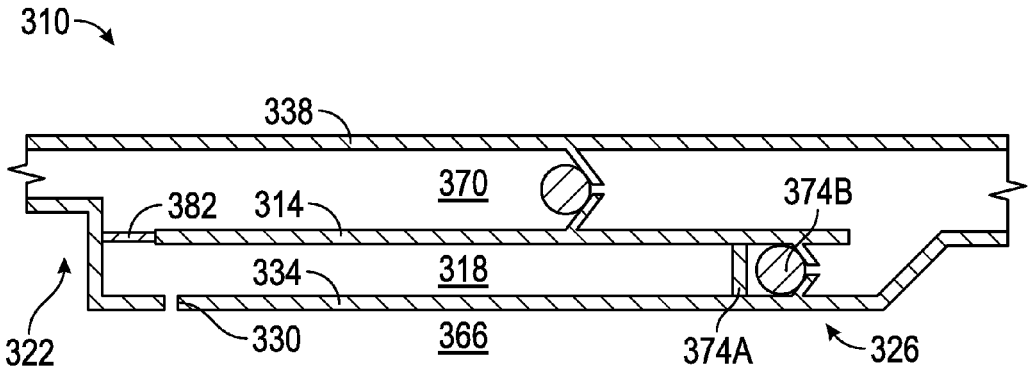
FIG. 3 depicts a cross sectional view of another alternate embodiment of a plug releaser disclosed herein.

Referring to FIG. 3, an alternate embodiment of a plug releaser disclosed herein is illustrated at 310. The plug releaser 310 performs similar functions to that of the plug releaser 10, albeit with fewer parts. The plug releaser 310 includes, a first tubular 314 defining a first chamber 318 that is plugged at two longitudinal locations 322, 326 by at least one plug 374A, 374B at one of the longitudinal locations 322, 326 and at least one plug 382 at the other of the two longitudinal locations 322, 326, with three plugs being illustrated. The first tubular 314 has at least one first port 330, with just one being shown in the drawing, through a wall 334 of the first tubular 314. A second tubular 338 is in fluidic communication with the first tubular 314 beyond the plugs 374A, 374B and 382 in both directions. The first port 330 establishes fluidic communication between the first chamber 318 and an outside 366 of both the first tubular 314 and the second tubular 338. Fluid flow through the first port 330 dampens or slows a rate of pressure change within the first chamber 318 in comparison to if the first port 330 were not present. A flow area of the first port 330 is selected to, at least temporarily, prevent building a pressure differential across the plugs 374A, 374B, 382 needed to rupture or release the plugs 374A, 374B, 382, at least in response to a range of pressure change rates within the first chamber 318 or at the outside 366. The increases in pressure differential across the plugs 374A, 374B, 382 can be due to increases in temperature of fluid within the chamber 18, for example, or by changes in pressure at the outside 366 or inside 370 of the second tubular 338, which could be due to changes in hydrostatic pressure in a downhole environment, for example. As such the plug releaser 310 prevents building a pressure differential across the plugs 374A, 374B, 382 needed to rupture the plugs 374A, 374B, 382 in two opposing directions for at least a period of time.

Figure 4:
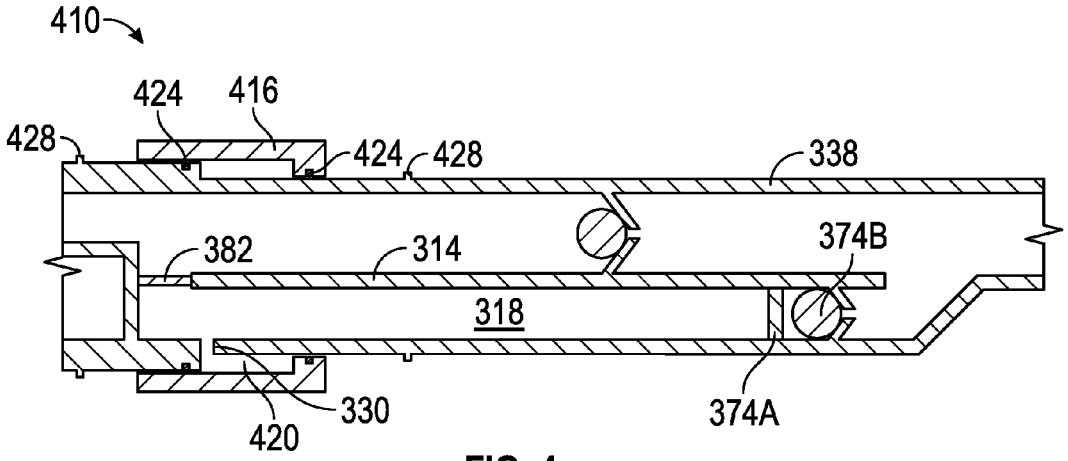
FIG. 4 depicts a cross sectional view of another alternate embodiment of a plug releaser disclosed herein.

Referring to FIG. 4, yet another embodiment of a plug releaser disclosed herein is illustrated at 410. The plug releaser 410 is similar to the plug releaser 310 and as such only the differences will be discussed hereunder in detail. The primary difference between the plug releasers 310 and 410 is the addition of a sleeve 416 being in operable communication with the first tubular 314 and the second tubular 338 in the plug releaser 410. The sleeve 416 is slidably sealingly engaged with the tubulars 314, 338 by seals 424. A second chamber 420 in this embodiment is defined in an annular space between the sleeve 416 and the tubulars 314, 338. The first port 330 fluidically connects the first chamber 318 to the second chamber 420. A volume of the second chamber 420 varies as the sleeve 416 is moved relative to the first tubular 314. The volume can increase in response to the sleeve 416 moving in one direction and the volume can decrease in response to the sleeve 416 moving in the opposite direction. Stops 428 can limit the travel of the sleeve 416 thereby also limiting the volumetric changes permitted in the second chamber 420. By limiting the volumetric changes of the second chamber 420 the plug releaser 410 prevents building a pressure differential across the plugs 374A, 374B, 382 needed to rupture the plugs 374A, 374B, 382 for at least a period of time.

Figure 5:
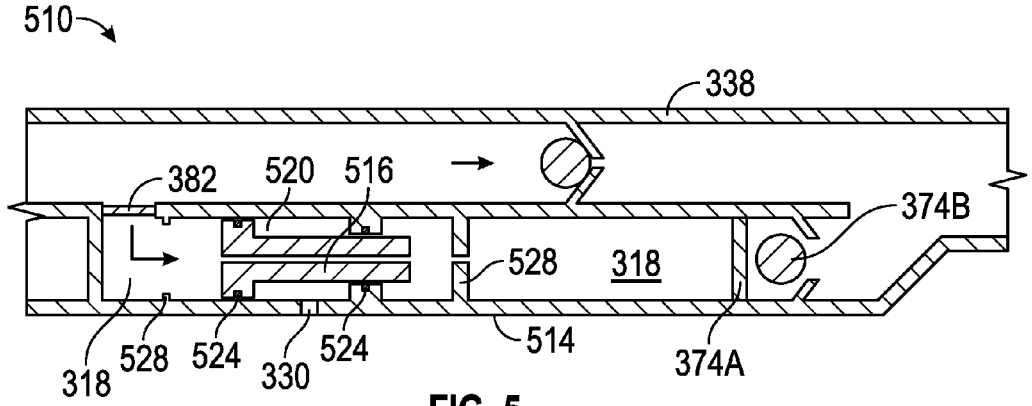
FIG. 5 depicts a cross sectional view of yet another alternate embodiment of a plug releaser disclosed herein.

Referring to FIG. 5, yet another embodiment of a plug releaser disclosed herein is illustrated at 510. The plug releaser 510 is similar to the plug releaser 410 and as such only the differences will be discussed hereunder in detail. The primary difference between the plug releasers 410 and 510 is the location of a second chamber. In the plug releaser 410 the second chamber 420 is radially outward of the first tubular 314, whereas in the plug releaser 510 a second chamber 520 is radially inside of a first tubular 514. The chamber 520 is defined between a sleeve 516 and the first tubular 514 and seals 524 slidingly sealably engaged therebetween. The first port 330 fluidically connects the second chamber 520 to an outside of both the first tubular 514 and the second tubular 338. A volume of the second chamber 520 varies as the sleeve 516 is moved relative to the first tubular 514. The volume can increase in response to the sleeve 516 moving in one direction and the volume can decrease in response to the sleeve 516 moving in the opposite direction. Stops 528 can limit the travel of the sleeve 516 thereby also limiting the volumetric changes permitted in the second chamber 520. By limiting the volumetric changes of the second chamber 520 the plug releaser 510 defines how long the plug releaser 520 can prevent building a pressure differential across the plugs 374A, 374B, 382 needed to rupture the plugs 374A, 374B, 382.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A plug releaser comprising:

a first tubular with at least one first port through a wall thereof;

at least two plugs sealingly engaged with the first tubular defining a first chamber between the first tubular and the at least two plugs, the at least two plugs being rupturable or releasable from the first tubular at selected pressure differentials thereacross; and a second tubular being in operable communication with the first tubular outside of the first chamber, the at least one first port providing fluidic communication between the first chamber and an outside of the first tubular, the at least one first port being sized to flow fluid from the first chamber to the outside of the first tubular to prevent pressure differential across the at least two plugs from building to a selected pressure differential needed to rupture or release the plugs in either direction for at least a period of time;

a third tubular that is in fluidic communication with the first tubular at two longitudinal locations of the first tubular when the at least two plugs are ruptured or released;

wherein at least one of the at least two plugs is releasable from a seat when the selected pressure differential exceeds a threshold value.

2. A plug releaser comprising:

a first tubular with at least one first port through a wall thereof;

at least two plugs sealingly engaged with the first tubular defining a first chamber between the first tubular and the at least two plugs, the at least two plugs being rupturable or releasable from the first tubular at selected pressure differentials thereacross;

a second tubular being in operable communication with the first tubular outside of the first chamber, the at least one first port providing fluidic communication between the first chamber and a space between the first and second tubulars, the at least one first port being sized to flow fluid from the first chamber to the space to prevent pressure differential across the at least two plugs from building to a selected pressure differential needed to rupture or release the plugs in either direction for at least a period of time; and a third tubular in fluid communication with the first tubular at two longitudinal locations of the first tubular when the at least two plugs are ruptured or released, wherein at least one of the at least two plugs flows into the third tubular upon release from the first chamber.

3. The plug releaser of claim 2, further comprising a sleeve slidably sealingly engaged with at least the first tubular defining a second chamber at least in part between the sleeve and the first tubular, the second chamber being in operable communication with the first chamber through the at least one first port, a volume of the second chamber being alterable in response to movement of the sleeve relative to the first tubular, travel limits of the sleeve determining how long a pressure differential across the at least two plugs can be maintained by the plug releaser below the selected pressure differential.

4. The plug releaser of claim 3, wherein the sleeve is movable in two directions to allow damping of pressure differential across the at least two plugs in two opposing directions.

5. The plug releaser of claim 2, wherein the second tubular has at least one second port through a wall thereof, and the second tubular is positioned radially of the first tubular defining an annular space between the first tubular and the second tubular; and further comprising a piston slidably positioned within the annular space dividing the annular space into a second chamber and a third chamber, the third chamber being in fluidic communication with an outside of the second tubular through the at least one second port, the piston being movable within the annular space in response to fluid flowing from the first chamber to the second chamber through the at least one first port.

6. The plug releaser of claim 5, wherein the piston is sealingly engaged with both the first tubular and the second tubular.

7. The plug releaser of claim 5, wherein a fourth tubular is slidable with respect to the second tubular a fourth chamber defined between the second tubular and the fourth tubular, and a fourth port in a wall of the second tubular fluidically connects the second chamber to the fourth chamber, the fourth chamber increasing in volume upon movement of the fourth tubular relative to the second tubular until movement thereof is stopped.

8. The plug releaser of claim 2, wherein a blockage at least temporarily within the third tubular allows pressure differential to build across the at least two plugs.

9. The plug releaser of claim 2, wherein the at least two plugs are positioned at two longitudinal locations of the first tubular.

10. The plug releaser of claim 2, wherein the at least one of the at least two plugs releasable from the seat is a ball.

11. The plug releaser of claim 2, wherein pressure changes within the third tubular can rupture or release at least one of the at least two plugs.

12. The plug releaser of claim 11, wherein the pressure changes are increases in pressure within the third tubular.

13. The plug releaser of claim 2, wherein at least one of the at least two plugs is a rupture disc.

14. The plug releaser of claim 2, wherein a volume of the first chamber is fixed.

15. A method of limiting pressure differential across the at least two plugs of the plug releaser of claim 2, the method, comprising:

porting fluid from the first chamber through the at least one first port to the outside of the chamber, the porting fluid thereby decreasing pressure differential across the at least two plugs in comparison to a method not including the porting of fluid regardless of a direction of pressure change across the at least two plugs that created the pressure differential across the at least two plugs.

16. The method of limiting pressure differential of claim 15, further comprising increasing pressure within the first chamber in response to temperature increases in fluid within the first chamber.

17. The method of limiting pressure differential of claim 15, further comprising changing pressure differential across the at least two plugs with changes in hydrostatic pressure outside the first chamber.

18. The plug releaser of claim 2, wherein the at least one of the at least two plugs releasable from a seat is a ball located at a first longitudinal location, and the at least two plugs further including a rupture disc at the first longitudinal location.

19. The plug releaser of claim 18, wherein the at least two plugs further includes a rupture disc at a second longitudinal location, the first chamber defined between the rupture discs.

* * * * *